US009526978B1

(12) United States Patent
Shoemaker, Jr.

(10) Patent No.: US 9,526,978 B1
(45) Date of Patent: Dec. 27, 2016

(54) VACUUM DROP ARCADE GAME

(71) Applicant: Stephen P. Shoemaker, Jr., Redondo Beach, CA (US)

(72) Inventor: Stephen P. Shoemaker, Jr., Redondo Beach, CA (US)

( * ) Notice: Subject to any disclaimer, the term of this patent is extended or adjusted under 35 U.S.C. 154(b) by 0 days.

(21) Appl. No.: 15/239,778

(22) Filed: Aug. 17, 2016

(51) Int. Cl.
*A63F 9/30* (2006.01)
*A63F 9/24* (2006.01)
*A63F 9/00* (2006.01)
*G07F 17/32* (2006.01)

(52) U.S. Cl.
CPC ..... *A63F 9/30* (2013.01); *A63F 9/0079* (2013.01); *A63F 9/24* (2013.01); *G07F 17/3209* (2013.01); *G07F 17/3246* (2013.01); *G07F 17/3248* (2013.01); *G07F 17/3251* (2013.01); *A63F 2009/0081* (2013.01)

(58) Field of Classification Search
CPC ..... A63F 9/24; A63F 9/30; A63F 9/079; A63F 2009/0081; G07F 17/3209; G07F 17/3246; G07F 17/3248; G07F 17/3251
See application file for complete search history.

(56) References Cited

U.S. PATENT DOCUMENTS 5,553,865 A * 9/1996 Shoemaker, Jr. ..... A63F 7/0058 108/20
6,428,008 B1 * 8/2002 Singer ..... B60P 3/025 273/447
6,770,001 B1 * 8/2004 Shoemaker, Jr. ..... A63F 9/30 273/448
7,857,318 B1 * 12/2010 Shoemaker, Jr. ..... A63F 9/30 273/447
8,070,167 B1 * 12/2011 Shoemaker, Jr. ..... A63F 9/30 273/447
8,079,596 B1 * 12/2011 Shoemaker, Jr. ... G07F 17/3297 273/447
2003/0011133 A1 * 1/2003 Uedono ..... A63F 9/30 273/447
2007/0126185 A1 * 6/2007 Fukuzawa ..... A63F 9/30 273/447
2008/0090629 A1 * 4/2008 Matsuda ..... A63F 9/30 463/7
2012/0025469 A1 * 2/2012 Shiino ..... A63F 9/30 273/447
2012/0056381 A1 * 3/2012 Shiino ..... A63F 9/30 273/448
2013/0214491 A1 * 8/2013 Shoemaker, Jr. ..... F41J 5/24 273/348
2014/0015199 A1 * 1/2014 Shoemaker, Jr. ..... G07F 17/32 273/447

* cited by examiner

*Primary Examiner* — Raleigh W Chiu
(74) *Attorney, Agent, or Firm* — Fulwilder Patton LLP

(57) ABSTRACT

A new arcade game utilizes a vacuum pick-up device to pick-up prizes from a protected silo on a moving playing field. The playing field can be a rotating turntable or conveyor belt, and multiple players can play at multiple player stations. The prizes can be lightweight cards, such as gift cards, that are stacked in silos on a platform that can rotate in one or two directions. Each player has a designated vacuum pick-up device that the player can move radially along the turntable so that, as the turntable rotates, each player can access to the entire playing field. If the player has correctly positioned the pick-up device, the pick-up device will lowing directly into a silo where the cards are located. The suction function is triggered, and the pick-up device will extract the gift card.

7 Claims, 8 Drawing Sheets

VACUUM DROP ARCADE GAME

BACKGROUND

The present invention is directed to arcade games, and more particularly to an arcade game where vacuum pick-up devices extract prizes from a rotating playing field.

Arcade games are well known in the art. There are video games, pinball games, bowling games, shooting games, and the like. One popular type of arcade game is a crane game, where a player maneuvers a crane or pick-up game over prizes or targets laid over playing field, and tries to extract the prize using the crane. Early versions of this type of game used a mechanical claw to extract plush animals and the like. The popularity of these games led to variations, including a vacuum pick-up device that is more versatile and can pick up a wider variety of targets. The present inventor has invented many new developments in this field, and has received many patents for both crane games and vacuum pick-up devices in particular.

SUMMARY OF THE INVENTION

The present invention is a new arcade game that utilizes a vacuum pick-up device to pick-up prizes from a protected by a silo. In this variation, the targets are arranged on a rotating turntable or conveyor belt, and multiple players can play at multiple player stations. The prizes can be light-weight cards, such as gift cards, that are stacked in silos on a platform that can rotate in one or two directions. Each player has a designated vacuum pick-up device that the player can move radially along the turntable so that, as the turntable rotates, each player can access to the entire playing field. Each player can stop the rotation of the playing field using his/her player controls, and the designated vacuum device immediately drops onto the playing field. If one player stops the playing field, the other players cannot continue an attempt to win a prize until the active player is finished. When the active player is finished, the playing field begins to rotate again and other players may stop the playing field themselves with an attempt. The skill is in controlling the pick-up device precisely at the time that the silo is under the pick-up device. In an alternate embodiment, the playing field does not stop and all players may try an extraction simultaneously.

If the player has correctly positioned the pick-up device, the pick-up device will lowing directly into a silo where the cards are located. The suction function is triggered, and the pick-up device will extract the gift card. If the player has not positioned the pick-up device correctly, the pick-up device will not extract a target and will return to the home position. The player must either pay for a new try, or a new player will take his place.

DETAILED DESCRIPTION OF THE PREFERRED EMBODIMENTS

Figure 1:
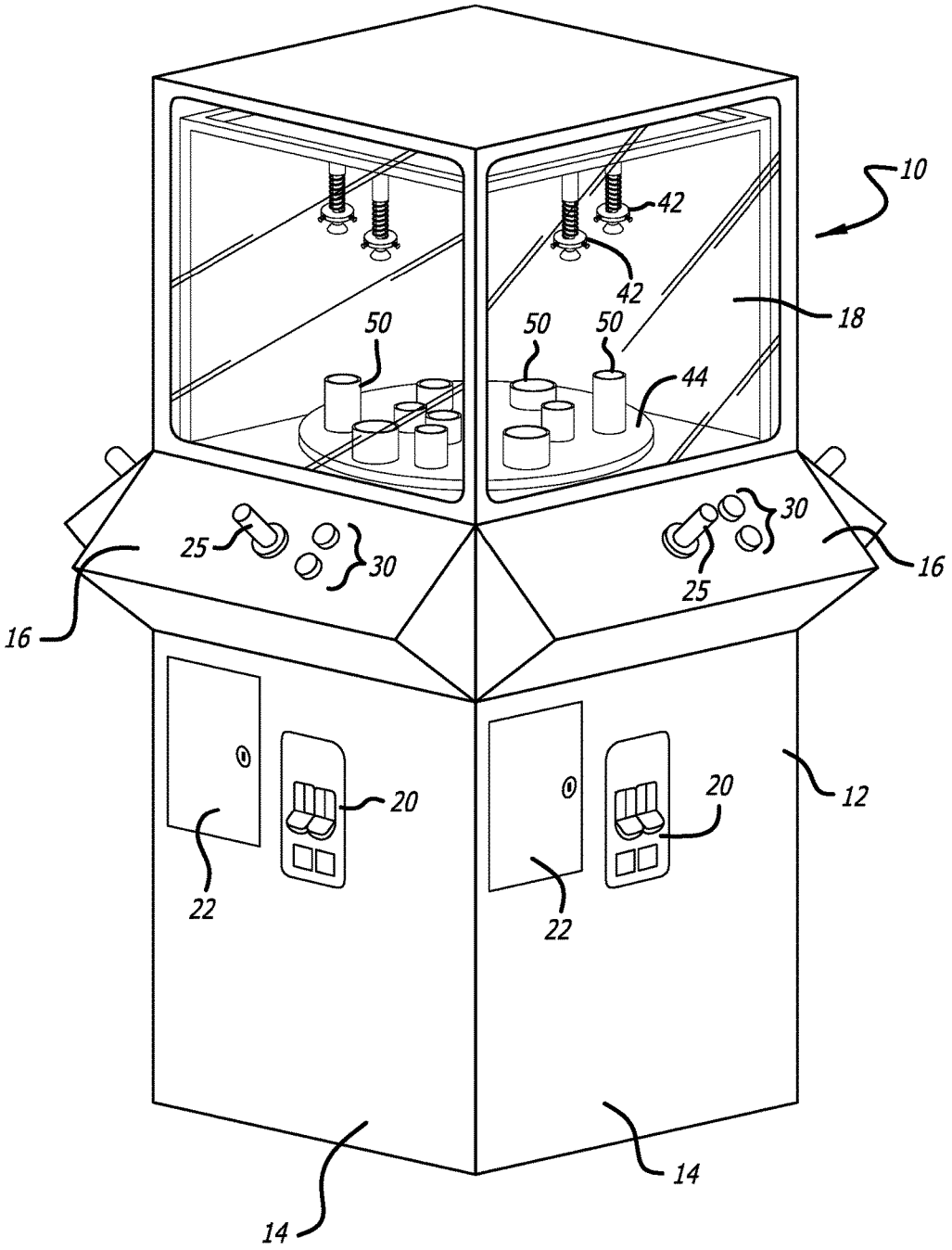
FIG. 1 is an elevated, perspective view of a first embodiment of the present invention.

A first preferred embodiment of the present invention is illustrated in FIG. 1. FIG. 1 illustrates an arcade crane game, which uses a vacuum extraction device described in U.S. patent application Ser. No. 14/838,980 entitled "Vacuum Crane Game," by the present inventor, the contents of which are fully incorporated herein by reference. The game apparatus 10 includes a housing 12 having multiple player sides. Each player side includes a front panel 14. Housings can take a wide variety of forms; for example, as shown in FIG. 1, housing 12 may be of a square configuration where players stand up to play, or there can be other versions in which a player sits on a stool when playing the game. In other embodiments, other types of housings may be provided. For example, a counter-top housing, including approximately the upper half of housing 12 shown in FIG. 1, can be used when the game apparatus 10 is desired to be placed on a table, counter top or other similar surface.

Front panel 14 includes a player control panel 16 that includes player controls 30. Front panel 14 includes a coin deposit slot 20, and a speaker may also be provided on the housing 12. Coin deposit slot 20 may be more generally thought of as a payment area, where the game can accept payment in the form of currency, coins, game tokens, bills, tickets, and the like. In some embodiments, other types of monetary input may also be provided using a magnetic card reader to read a card with a magnetic strip that holds game credit information, or a bank card such as a credit card, debit card, etc. A token deposited in coin deposit slot 20 (or other payment method) starts a game. Dispenser compartment 22 is used to provide access to the retrieval bin in the event of a successful attempt by the player.

The front panel 14 can also include other features if appropriate. Player control panel 16 allows a player to manipulate events in the game, and includes player controls 30 such as an actuation device such as a forward and backward button to control the movement of the extraction device 42 in a radial direction with respect to the turntable 44. Alternatively, the movement of the extraction device in the two dimensional X-Y plane can be controlled by a joystick 25, roller ball, touchscreen, or other input device. Each player's extraction device 42 is suspended above the turntable 44 and is responsive to the player's controls so that the player can position the extraction device 42 either along a radial line of the turntable 44 or moved within the player's quadrant.

At the bottom of the playing area 18 is a motorized turntable that supports a plurality of cylindrical columns or silos 50, which may have different heights and diameters. Each silo 50 houses a stack of targets, such as gift cards. The target area formed by the silo wall is dimensioned so as to be slightly larger than the largest dimension (e.g., a diameter) of the extraction device 42. Thus, only by precisely hovering the extraction device 42 over the silo's target area can the player successfully lower the extraction device into the silo 50 to collect a gift card 51.

Figure 2:
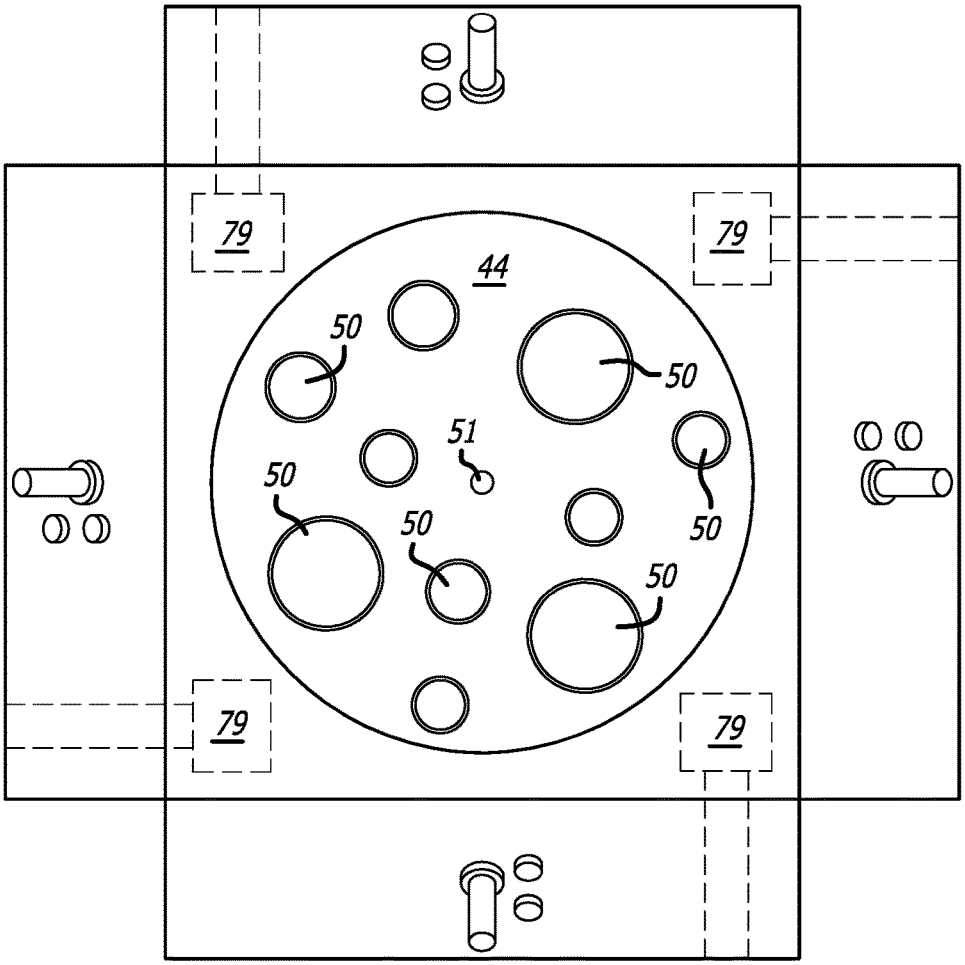
FIG. 2 is a top view of the playing field and the multi-player stations.
Figure 3:
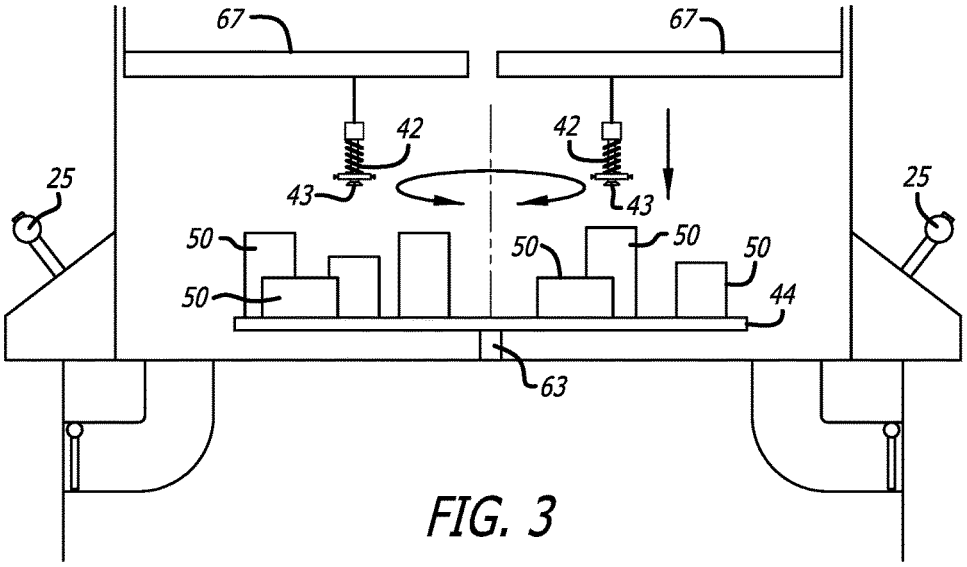
FIG. 3 is a side view of the playing field and two player stations.
Figure 4:
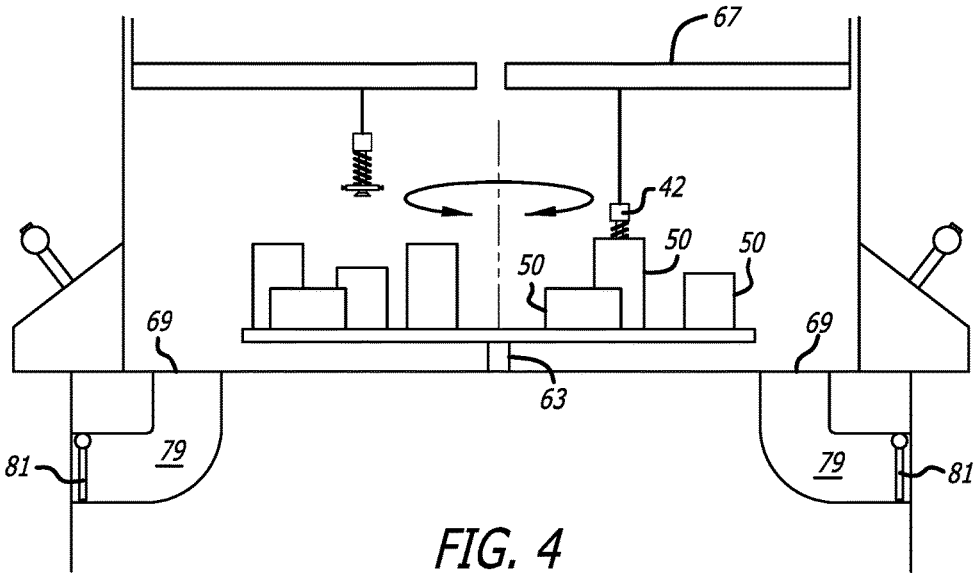
FIG. 4 is a side view showing the movement of the pick-up device.

FIGS. 2 and 3 show a top view and side view, respectively, of the turntable 44 and silos 50 that rotate about a center 51. A motor 60 below the turntable 44 rotates the turntable on a spindle 63, pursuant to signals from a control unit 65. The turntable can rotate back and forth, or three hundred sixty degrees in a continuous motion. Each player station has the opportunity to stop by the turntable by activating that player's controls, which temporarily stops the motor and freezes the turntable. Once a player stops the turntable, the other players must wait until that player's attempt is concluded before initiating their attempt. That player's pick-up device 42 (see FIG. 4) drops from a railing 67 upon command of the player using a motorized control (not shown). Silos 50 of targets are below, and a properly positioned pick-up device 42 will lower directly into a silo 50, whereupon the vacuum switch is triggered causing suction to be applied through a suction cup 43. The suction cup 43 will bear against an uppermost card in the silo 50, and lift the card out of the silo 50 if successful. The pick-up device 42 then moves over an opening 69 in the floor of the playing field that leads to a retrieval bin 79. The control unit 65 then deactivates the vacuum to release the card into the opening 69 and retrieval bin 79, where a player can push open a door 81 to collect the prize from the retrieval bin 79. If no prize is won, the game simply returns to a home position over the prizes.

Figure 8:
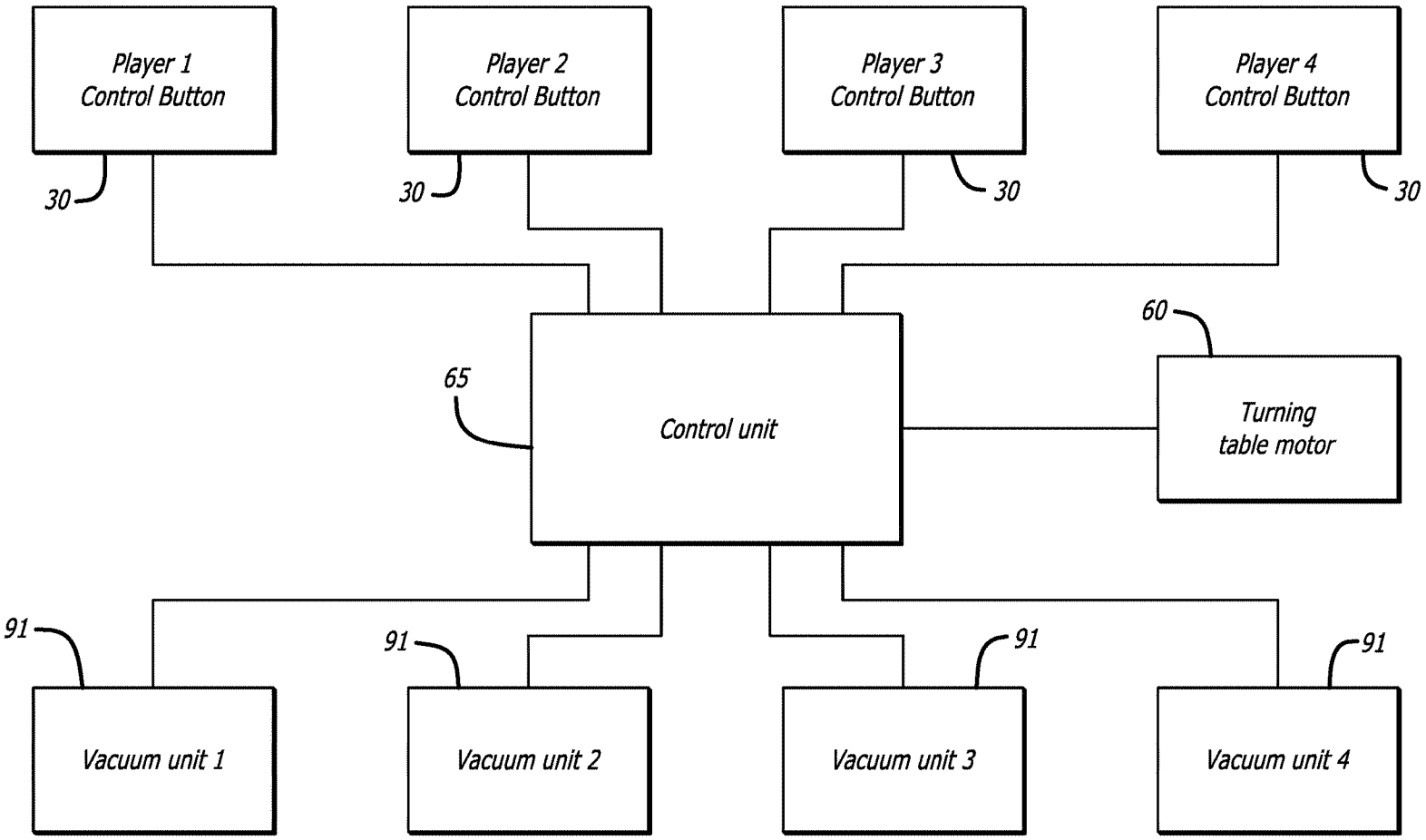
FIG. 8 is a schematic diagram of the arrangement of the player controls and vacuum units of the embodiment of FIG. 1.
Figure 9:
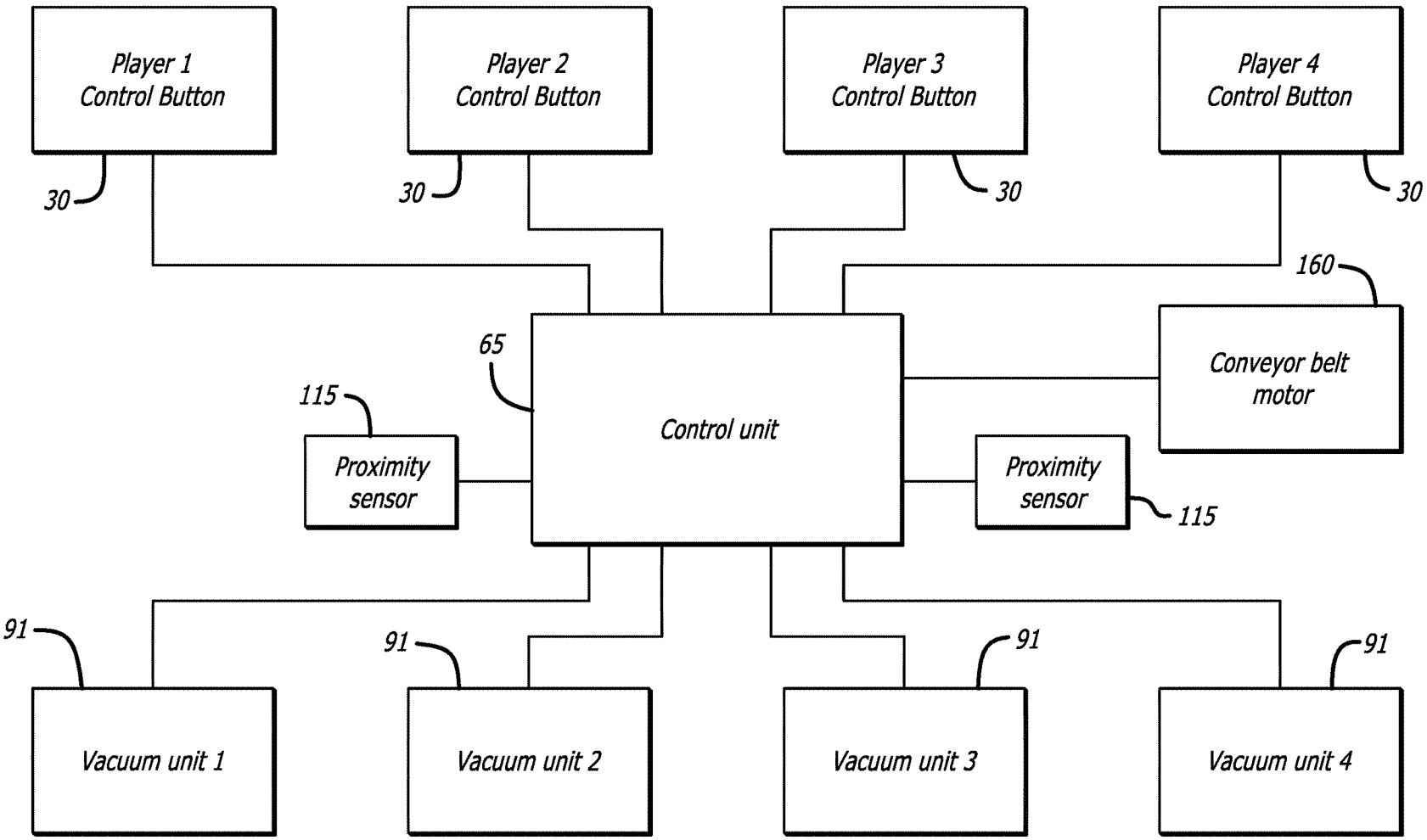
FIG. 9 is a schematic diagram of the arrangement of the player controls and vacuum units of the embodiment of FIG. 2.

FIG. 8 is a schematic of the operation of the game, where a central control unit 65 operates both the turntable motor 60 and the individual player's vacuum units that supply the pick-up devices with their suction. Each player has player controls 30 that are used to move the pick-up devices 42, and send signals to the control unit 65 that are interpreted by the control unit. The control unit 65 then sends signals to the vacuum unit 91 to activate the suction in that player's pick-up device. The control unit also sends signals to the movement mechanism for each pick-up device responsive to the player's controls 30 to maneuver the pick-up device 42 and to stop the motor 60 rotating the turntable 44. The control unit 65 also automatically controls the movement of each pick-up device after an attempt has been made, either to place the pick-up device over the opening 69 leading to the retrieval bin after a successful attempt, or to return the pick-up device to a home position after a failed attempt.

Figure 5:
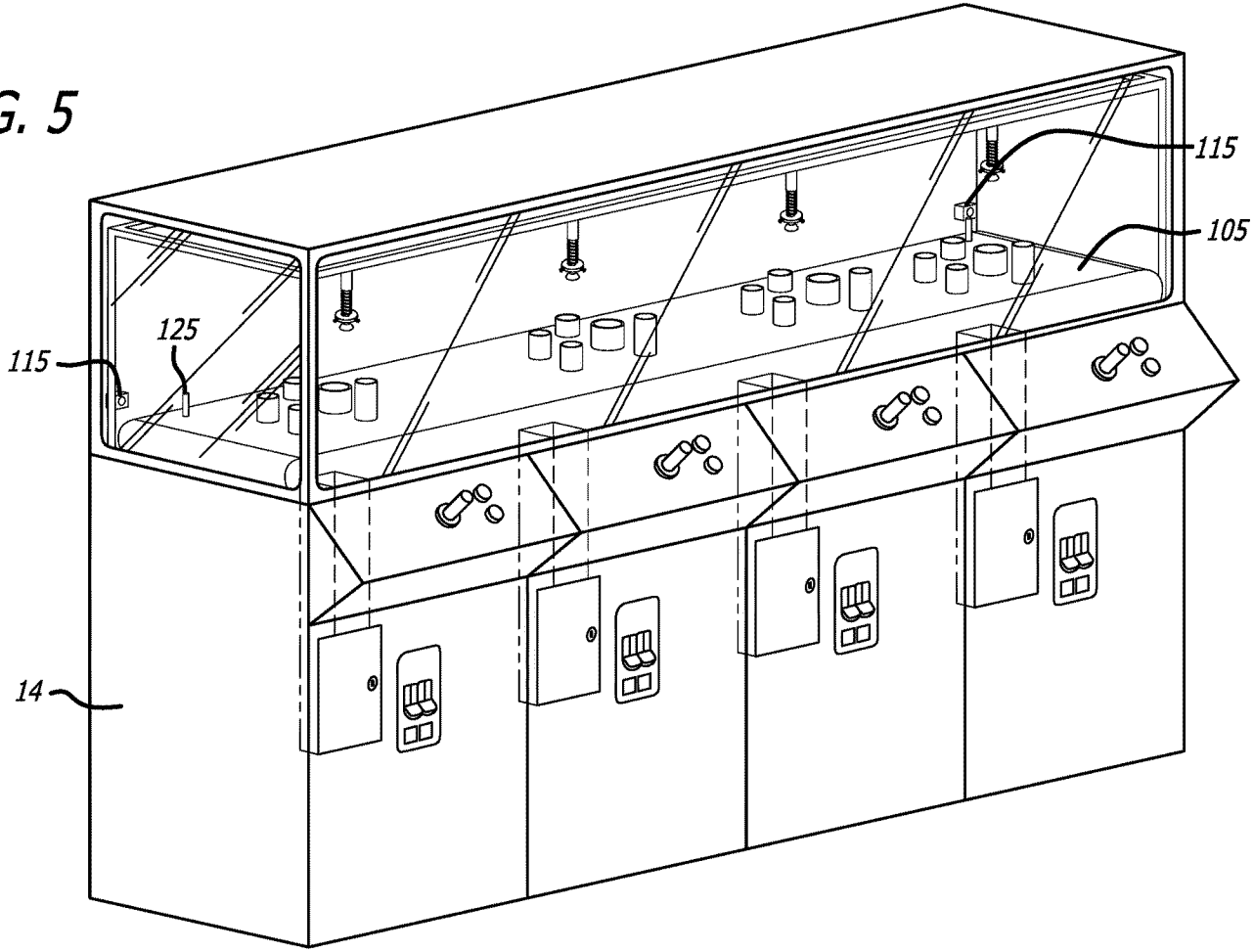
FIG. 5 is an elevated, perspective view of a second embodiment of the present invention.
Figure 6:
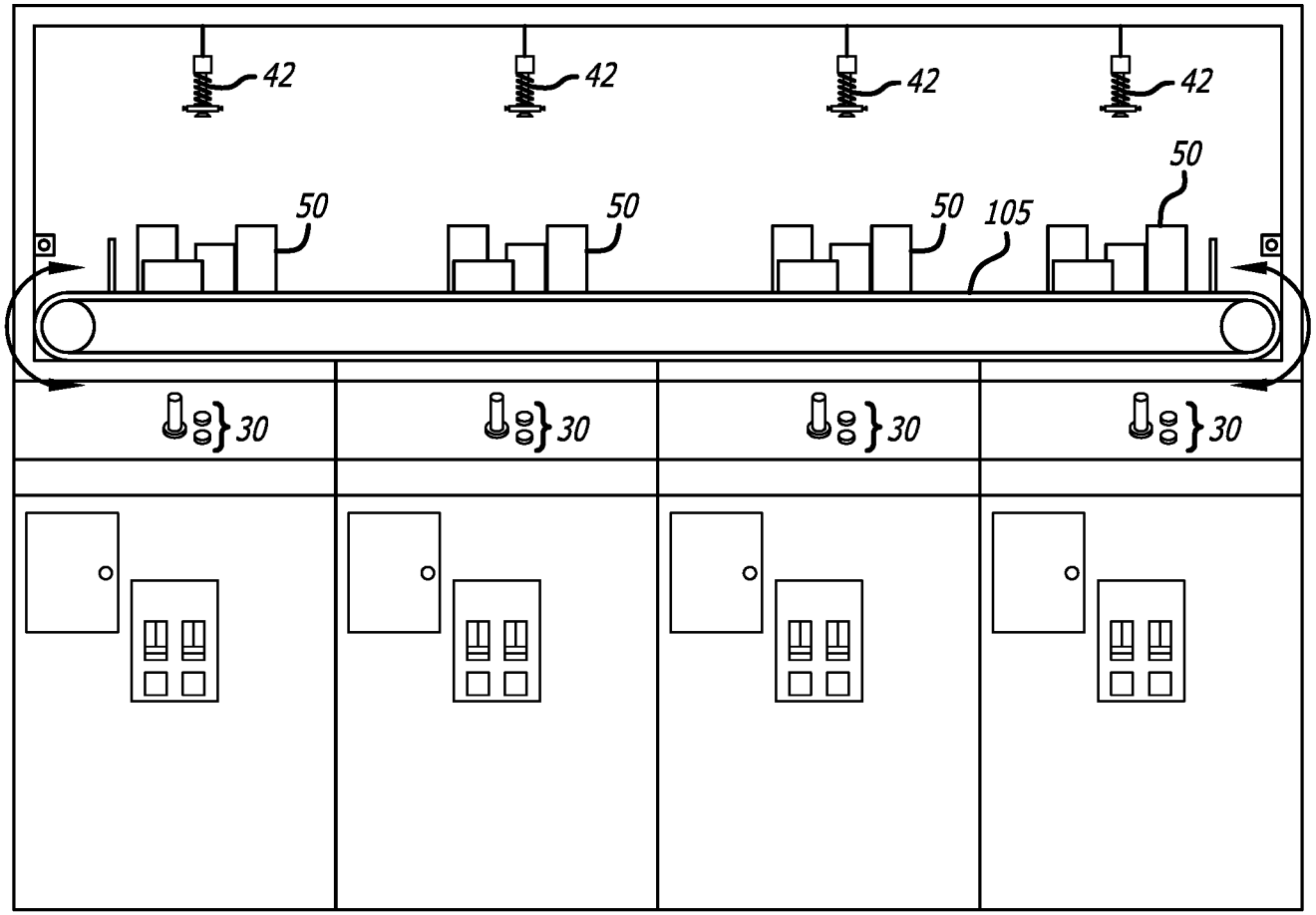
FIG. 6 is a front view of the embodiment of FIG. 5.

FIG. 5 illustrates a second embodiment of the present invention, where like numbers represents like structure as compared with the elements of the embodiment of FIG. 1. In the embodiment of FIG. 5, the housing 114 is an elongate rectangular structure that allows multiple player stations linearly arranged. Inside the playing area is an elongate conveyor belt 105 onto which is disposed a plurality of silos 50 containing targets, such as gift cards. As shown in FIG. 6, the conveyor belt 105 rotates back and forth, or oscillates, in front of each player station so that the silos 50 are constantly moving. The skill can be adjusted by controlling the speed by which the motor moves the conveyor belt, or making the movement non-constant or sporadic. Positioned at each end of the conveyor 105 may be a proximity sensor 115 that detects a marker 125 as it passes in front of the optical sensor. When the proximity sensor 115 detects the presence of the marker 125, it sends a signal to the control unit 65 to reverse the conveyor belt motor 160. By placing a proximity sensor 115 at each end, the motor can self-sustain the oscillating motion by constantly reversing the motion of the conveyor belt 105.

Figure 7:
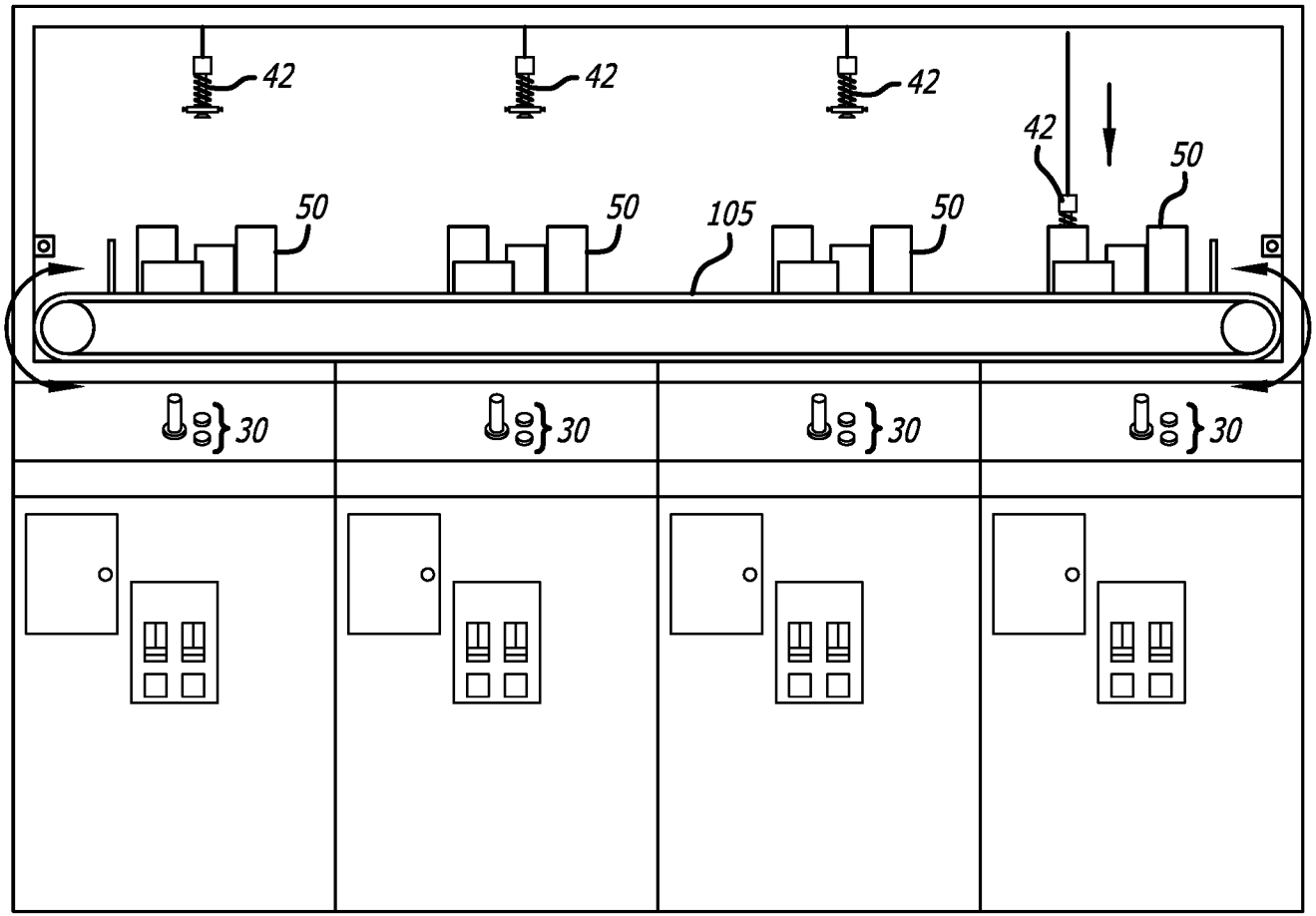
FIG. 7 is a front view of the movement of the pick-up device in the second embodiment.

The player at each station moves the pick-up device 42 associated with that station over the selected silo in an attempt to withdraw a prize. Once the player hits a "stop" button on the player controls 30, the conveyor belt stops and the pick-up device immediately drops from its position (FIG. 7). If the pick-up device 42 is correctly positioned immediately above the silo 50, it will enter the silo 50 when it drops and can extract a target as set forth above. If the pick-up device hits the silo or misses the silo, the pick-up device will rise and return to a home position and a new attempt must occur.

There are many variations and changes that can be made to the foregoing embodiments that would be recognized by one of ordinary skill in the art, and the present invention is intended to include and incorporate all such variations and changes. For example, the playing field may rotate continuously, intermittently, or only when a player initiates an attempt at a prize. Thus, the scope of the invention is not intended to be limited by any of the descriptions or depictions in the figures, but rather solely by the words of the appended claims using their customary and ordinary meanings, in light of descriptions herein.

I claim:

1. An amusement game, comprising:

a housing including multiple player stations, each player station having player controls including a pick-up device positioning control;

a playing field within a windowed portion of the housing, the playing field including a turntable rotated by a motor;

a plurality of target silos disposed on the playing field, each target silo including at least one target;

a pick-up device associated with each player station and controlled by said player station's player controls, the pick-up device including a suction cup for applying suction to a target;

a retrieval bin associated with each player station for collecting a prize won by that player;

wherein the player controls position the pick-up device over a silo and the pick-up device lowers into a silo to extract a target, and wherein the target is then dropped in the player's retrieval bin; and wherein multiple players can play on the same playing field using the individual controls.

2. The amusement game of claim 1, wherein the playing field includes a rotating turntable that supports the silos.

3. The amusement game of claim 1, wherein the playing field includes a conveyor belt that rotates from side to side, and wherein the silos are mounted on the conveyor belt.

4. The amusement game of claim 1, wherein the targets are gift cards.

5. The amusement game of claim 1, wherein the player controls include a joystick.

6. The amusement game of claim 1, wherein the player stations are arranged around the housing.

7. The amusement game of claim 1, wherein the player stations are arranged linearly.

* * * * *